US006517364B2

(12) United States Patent
Muramatsu et al.

(10) Patent No.: US 6,517,364 B2
(45) Date of Patent: Feb. 11, 2003

(54) CONNECTOR-WITH-LEVER

(75) Inventors: Kenji Muramatsu, Shizuoka-ken (JP); Toshiharu Kawashima, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/788,645

(22) Filed: Feb. 21, 2001

(65) Prior Publication Data

US 2001/0053621 A1 Dec. 20, 2001

(30) Foreign Application Priority Data

Feb. 23, 2000 (JP) ..... 2000-046147

(51) Int. Cl.[7] ..... H01R 13/62
(52) U.S. Cl. ..... 439/157; 439/752
(58) Field of Search ..... 439/157, 159, 439/352, 160, 341, 372

(56) References Cited

U.S. PATENT DOCUMENTS 5,104,330 A * 4/1992 Yagi et al. ..... 439/157
5,230,635 A * 7/1993 Takenouchi et al. ..... 439/157
5,476,390 A * 12/1995 Taguchi et al. ..... 439/157

FOREIGN PATENT DOCUMENTS

JP 4-72479 6/1992

* cited by examiner

*Primary Examiner*—P. Austin Bradley
*Assistant Examiner*—Briggitte Hammond
(74) *Attorney, Agent, or Firm*—Finnegan, Henderson, Farabow, Garrett, & Dunner, L.L.P.

(57) ABSTRACT

A connector-with-lever comprising a first connector (11), a second connector (12) and a lever (14) turnably mounted to a connector housing (13) of the first connector (11), in which the first connector (11) and the second connector (12) are connected to each other by operating the lever (14), wherein the connector-with-lever further comprises lever locking means (18A), (23) for temporarily lock the lever (14) with the connector housing before the first connector (11) and the second connector (12) are connected to each other, and unlocking means (28) for unlocking the temporary locking state of the lever (14) when the first connector (11) and the second connector (12) start being connected to each other.

3 Claims, 6 Drawing Sheets

CONNECTOR-WITH-LEVER

BACKGROUND OF THE INVENTION

1. Field of the Invention

The present invention relates to a connector structure for connecting male and female connectors by a low insertion force using a lever, and more particularly, to an inexpensive connector-with-lever in which the number of parts is small and connecting operation is excellent.

2. Description of the Related Art

As shown in FIG. 1 (not prior art), there is a proposed connector-with-lever, which comprises a first connector 2, a second connector 6 and a substantially U-shaped lever 4. The lever 4 pivotally supported by opposite ends of a connector housing 3 of the first connector 2. A torsion coil spring 5 is interposed between the connector housing 3 and the lever 4. The lever 4 is biased in a direction X in FIG. 7 with respect to the connector housing 3 by the torsion coil spring 5.

The lever 4 is temporarily locked by a temporary locking member (not shown) at the side of the connector housing 3 for holding the temporary locking state shown in FIG. 2 in a state in which the second connector 6 is not fitted to the connector housing 3. When the second connector 6 is fitted to the connector housing 3, the temporary locking member is unlocked.

When the second connector 6 having the above structure is fitted to the connector housing 3, guide pins 6A, 6A projecting from opposite sides of the second connector 6 are inserted into insertion guide grooves 4A, 4A formed in the lever 4, and when the temporary locking members are unlocked, the lever 4 is biased in an direction opposite from the X direction shown in FIG. 7, the second connector 6 is reliably fitted into the connector housing 3, and connecting terminals disposed in both the members are connected to each other.

However, in the case of the connector-with-lever 1, when the lever 4 is mounted to the connector housing 3, the torsion coil spring 5 is incorporated. Therefore, the assembling operation becomes complicated, and skill is required for the assembling operation. Further, there are problems that the operability is inferior, the torsion coil spring 5 is expensive and thus, cost of the connector 1 having lever is high.

Further, in the case of the above-described connector 1 having lever, when the second connector 6 is not fitted to the connector housing 3, since the lever 4 is temporarily locked by the connector housing 3 in a state in which the lever 4 is biased by the torsion coil spring 5, the lever 4 turns in accordance with biasing forces of the torsion coil spring 5 due to unexpected external force, inlets of the insertion guide grooves 4A, 4A are turned upward, and the second connector 6 can not be fitted. Therefore, if the lever 4 was turned, it is necessary an assembling operator to return the lever 4 to it original positions against the biasing forces of the torsion coil spring 5 and then, to fit the second connector 6. For this reason, there is a problem that when the fitting operation is carried out in a narrow space such as an engine room of an automobile, the assembling operability is largely lowered.

SUMMARY OF THE INVENTION

Thereupon, it is an object of the present invention to provide an inexpensive connector capable of easily mounting lever to a connector housing, and capable of easily connecting a first connector and a second connector.

To achieve the above object, according to a first aspect of the invention, there is provided a connector-with-lever comprising a first connector, a second connector and a lever turnably mounted to a connector housing of the first connector, in which the first connector and the second connector are connected to each other by operating the lever, wherein the connector-with-lever further comprises lever locking means for temporarily lock the lever with the connector housing before the first connector and the second connector are connected to each other, and unlocking means for unlocking the temporary locking state of the lever when the first connector and the second connector start being connected to each other.

With the first aspect, before the first connector and the second connector are connected to each other, since the connector housing and the lever are temporarily locked with each other by the lever locking means, it is possible to prevent the lever from moving unintentionally even in a connection-standby state, and the connected state between both the connectors can be held.

When the connection between the connectors is stated, the temporary locking state of the lever is unlocked for the first time, the temporary locking state of the lever is held unless the connectors are connected.

According to a second aspect of the invention, in the connector-with-lever of the first aspect, the lever locking means comprises a locking opening formed in the connector housing, and a locking projection piece which projects from the lever, the locking projection piece is inserted into and engaged with the locking opening, and the lever holds the temporary locking state with respect to the connector housing.

With the second aspect, in addition to the effect of the first aspect, the lever locking means comprises a locking opening formed in the connector housing, and a locking projection piece which projects from the lever, the locking projection piece is inserted into and engaged with the locking opening, and the lever is temporarily locked with respect to the connector housing. Therefore, it is possible to hold the lever in the temporary locking state with a simple structure without using a spring or the like.

According to a third aspect of the invention, in the connector-with-lever of the first aspect, the unlocking means comprises a projection formed on a connector housing of the second connector, the projection abuts against the locking projection piece to push the locking projection piece from the locking opening out of a housing, thereby unlocking the temporary locking state of the lever.

With the third aspect, in addition to the effect of the first aspect, since the unlocking means is merely a projection formed on a connector housing of the second connector, the connector structure is extremely simple, and the molding die for the connector can be produced inexpensively.

DESCRIPTION OF THE PREFERRED EMBODIMENT

Figure 1:
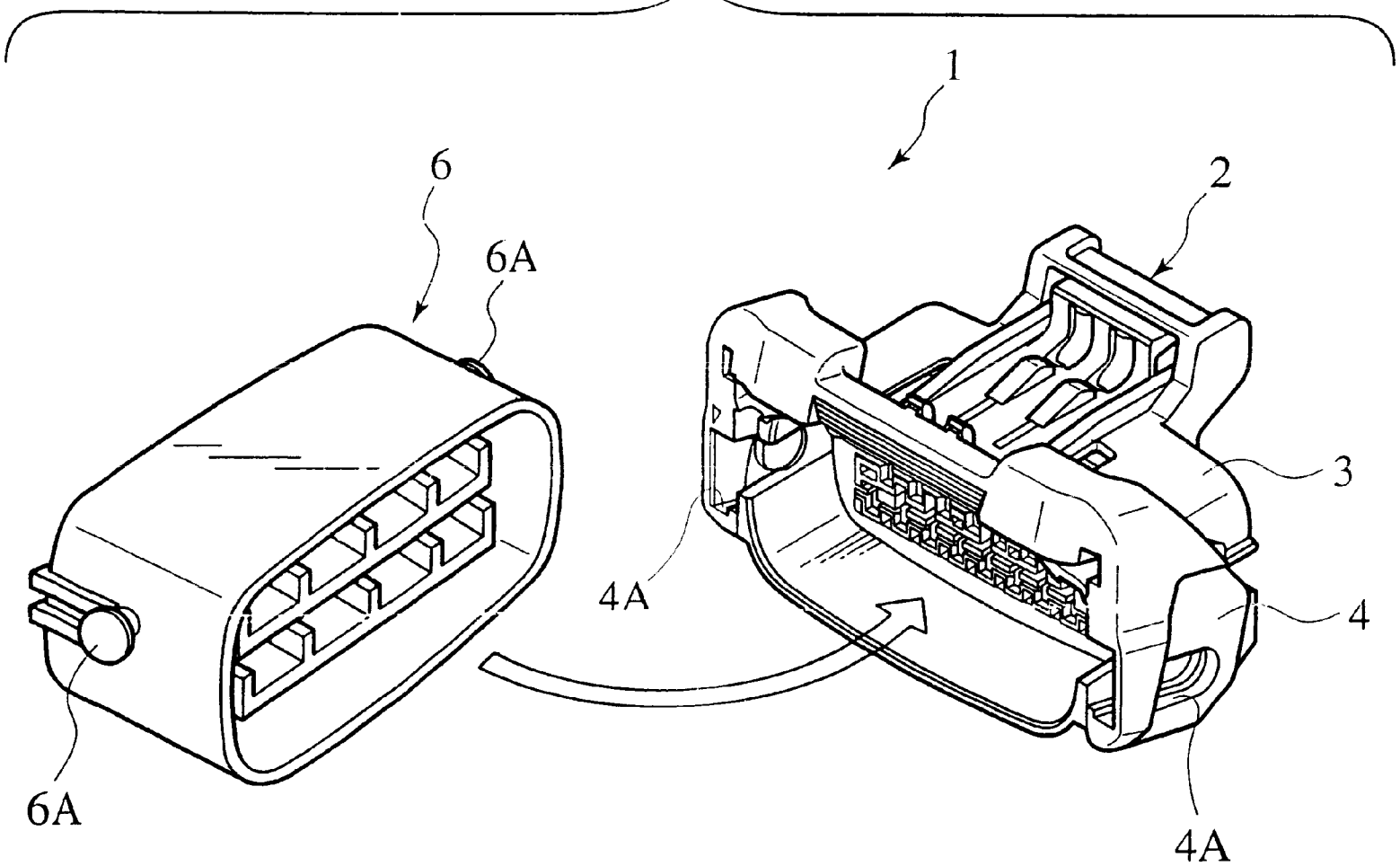
FIG.1 PRIOR ART
FIG. 1 is a perspective view of proposed connectors.
Figure 2:
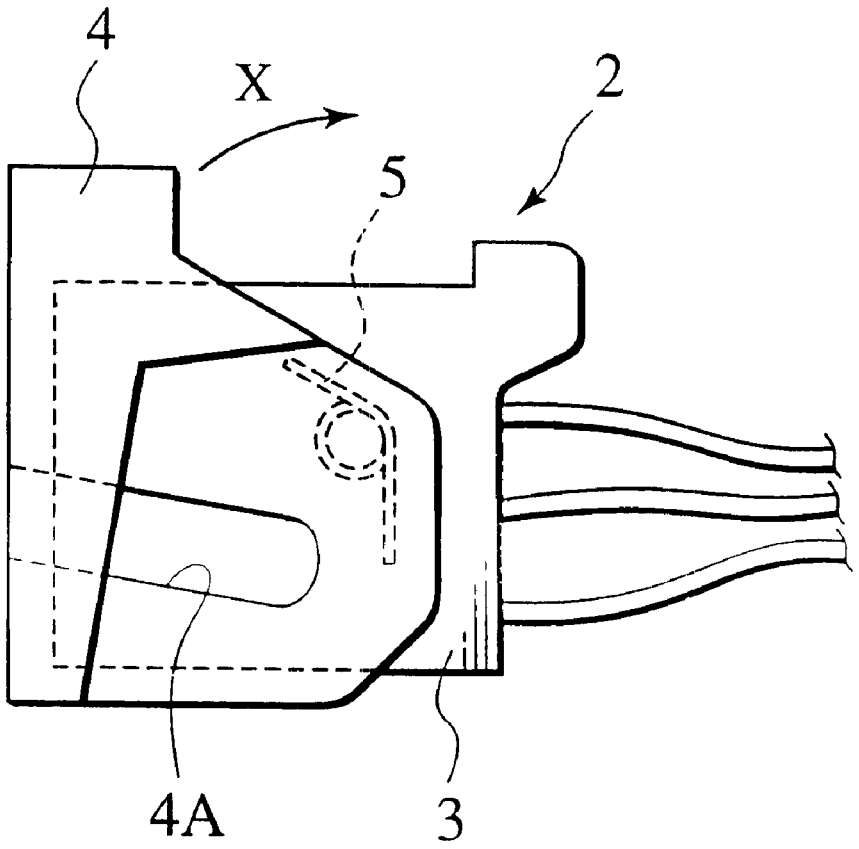
FIG.2 PRIOR ART
FIG. 2 is a side view one of the proposed connectors.

A connector-with-lever according to the present invention will be explained in detail below based on an embodiment shown in the drawings.

<Structure of Connector-With-Lever>

Figure 3:
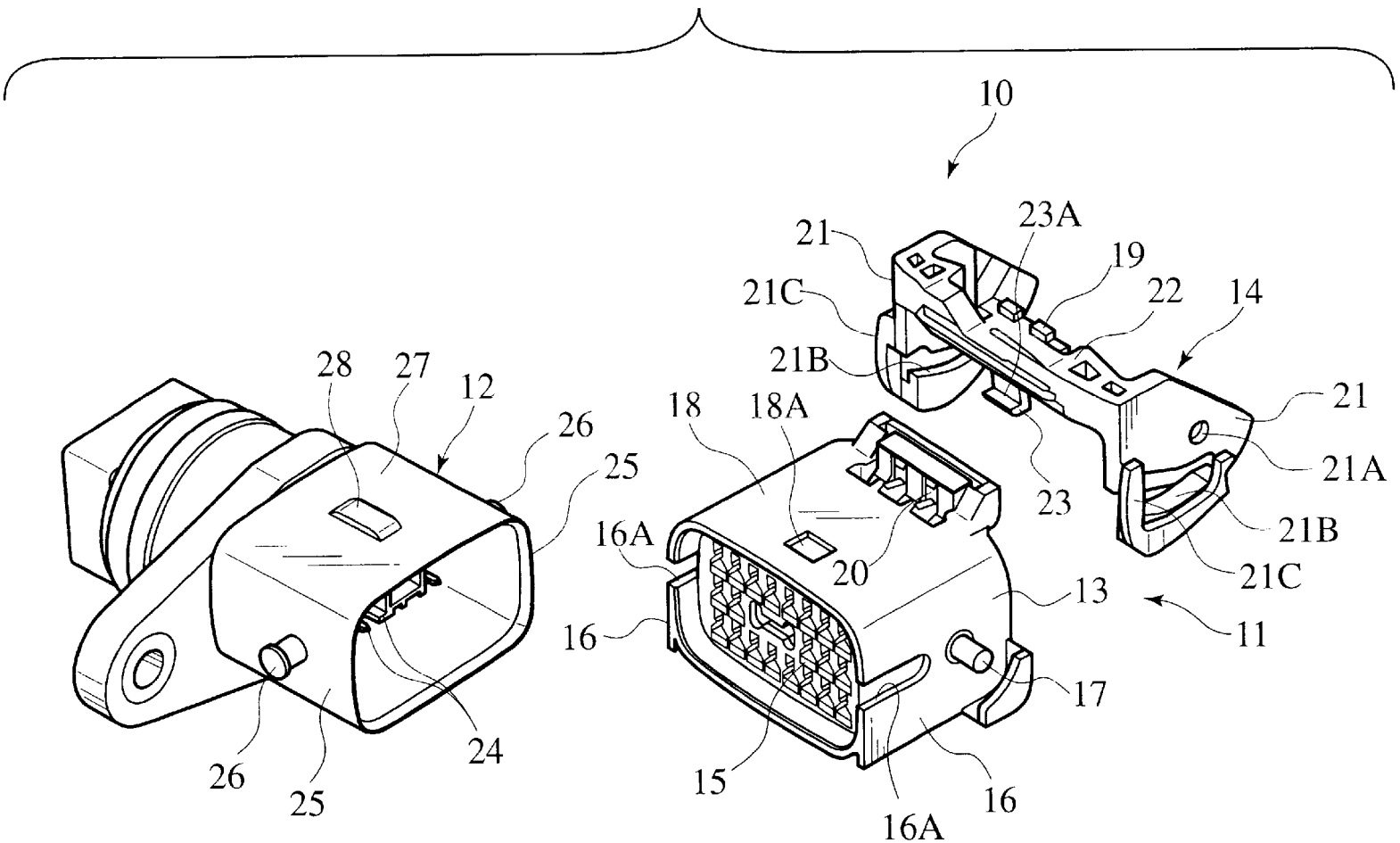
FIG. 3 is an exploded perspective view showing an embodiment of a connector according to the present invention.

FIG. 3 is an exploded perspective view showing a connector-with-lever of the embodiment. As shown in FIG. 3, a connector-with-lever 10 comprises a first connector 11, a second connector 12 and a lever 14 rotatably mounted to the first connector 11.

[First Connector]

The first connector 11 includes a substantially cylindrical connector housing 13. The connector housing 13 has a front opening into which the second connector 12 is fitted. A plurality of female terminals 15 are arranged vertically and horizontally in the connector housing 13. Electric wires are connected to the female terminals 15 from rear ends thereof.

Guide grooves (slits) 16A are formed on opposite side walls 16, 16 of the connector housing 13 in a back-and-forth direction (fitting direction). The guide grooves 16A are notched from their front ends to their substantially central portions. A lever pivot shaft 17 projecting sideway is integrally formed on each of the side walls 16, 16 at its location slightly rear from its central portion.

A rectangular locking opening 18A is formed on a front side of an upper wall 18 of the connector housing 13 such as to pass through into the housing. To-be engaged portions 20 to which engaging portions 19 of the lever 14 (which will be described later) are engaged are formed on a rear portion of the upper wall 18.

[Lever]

The lever 14 comprises a pair of left and right lever side plates 21, 21 on which shaft holes 21A are formed. Lever pivot shafts 17 projecting from the side walls 16, 16 of the connector housing 13 are fitted into the shaft holes 21A. The lever 14 further comprises a connecting plate 22 for connecting upper portions of the pair of left and right lever side plates 21, 21 to each other.

The lever pivot shafts 17 are fitted into the shaft holes 21A formed in the lever side plates 21, and the lever 14 is movably assembled into the connector housing 13. Each of engaging guide grooves (slits) 21B is formed into such a shape that the engaging guide groove 21B is curved rearward and downward from a front end edge of the lever side plate 21. A reinforcing frame 21C is formed on each of the lever side plates 21 astride the engaging guide groove 21B from outside.

A locking projecting piece 23 projecting downward is integrally formed on a front portion of a center portion of a lower surface of the connecting plate 22 of the lever 14. The locking projecting piece 23 is inserted into the locking opening 18A formed in the upper wall 18 of the connector housing 13, and a tip end 23A of the locking projecting piece 23 is locked at the opening edge of the locking opening 18A. The tip end 23A of the locking projecting piece 23 is pushed from front side to back side in the connector housing 13 (in its fitting direction). With this operation the temporary locking state between the tip end 23A and the opening edge of the locking opening 18A is unlocked, and the tip end 23A is pushed out from the connector housing 13 eventually.

The structure for pushing out and discharge the tip end 23A of the locking projecting piece 23 from the locking opening 18A is formed by appropriately setting shapes of the locking opening 18A and the tip end 23A. More specifically, the structure is set by a longitudinal length of the locking opening 18A and a direction of turning locus of the locking projecting piece 23 which turns around the lever pivot shafts 17.

The engaging portions 19 formed on the rear end of the connecting plate 22 of the lever 14 are set such that the engaging portions 19 engage the to-be engaged portions 20 formed on the rear portion of the upper wall 18 of the connector housing 13.

[Second Connector]

The second connector 12 is formed into a cylindrical hood capable of fitting into the connector housing 13. In the second connector 12, male terminals 24 to be connected to the female terminals 15 in the connector housing 13. Cylindrical guide projections 26 to be inserted into the guide grooves 16A and the engaging guide grooves 21B are projecting from opposite side walls 25 of the second connector 12. When the guide projections 26 are fitted to the connector housing 13, the guide projections 26 are inserted into the guide grooves 16A and the engaging guide grooves 21B. An unlocking projection 28 which is unlocking means for unlocking the temporary locking state of the lever 14 is formed on an upper wall 27 of the second connector 12.

<Connecting Operation>

Figure 4:
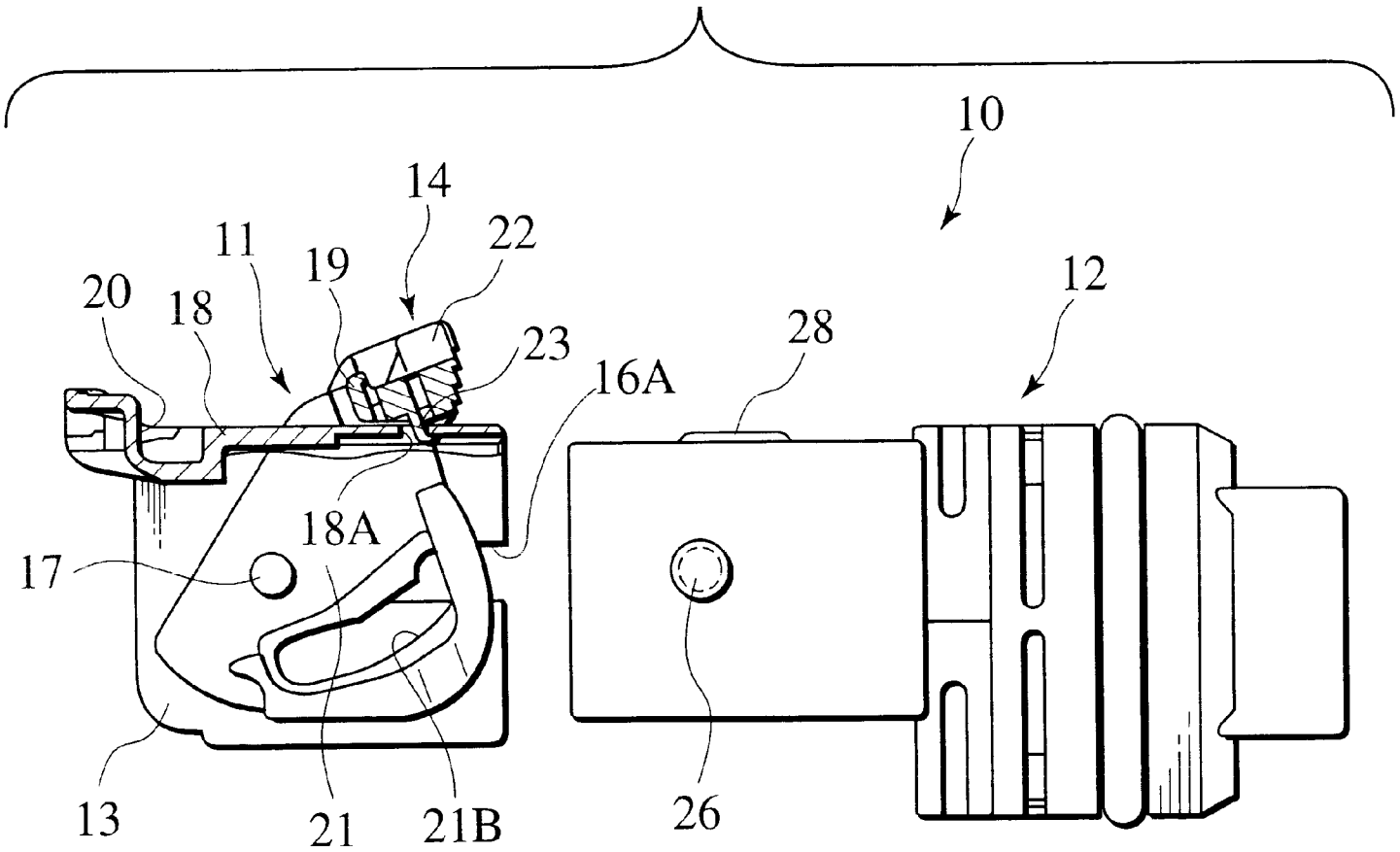
FIG. 4 is a side view showing a state in which a first connector and a second connector of the embodiment are not yet connected to each other.

Next, operation of the connector-with-lever 10 having the above-described structure will be explained with reference to FIGS. 4 to 7. First, as shown in FIG. 4, the locking projecting piece 23 of the lever 14 pivotally supported by the connector housing 13 is inserted into the locking opening 18A formed in the upper wall 18 of the connector housing 13, and the tip end 23A is locked by the opening edge. In this state, the guide grooves 16A of the connector housing 13 and the tip end of the engaging guide groove 21B of the lever 14 are in their superposed positions. Then, as shown in FIG. 4, if the first connector 11 and the second connector 12 are approached and fitted to each other, the guide projections 26 enters into the guide grooves 16A and the engaging guide groove 21B.

Figure 5:
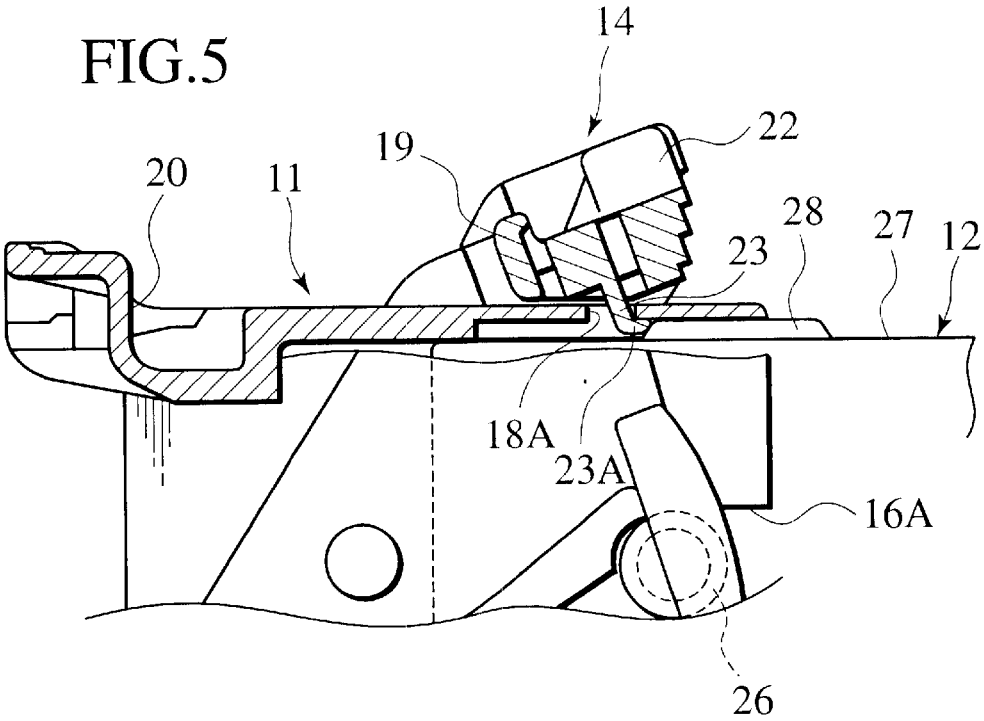
FIG. 5 is a sectional view of an essential portion of a state in which the first connector and the second connector of the embodiment are initially fitted to each other.
Figure 6:
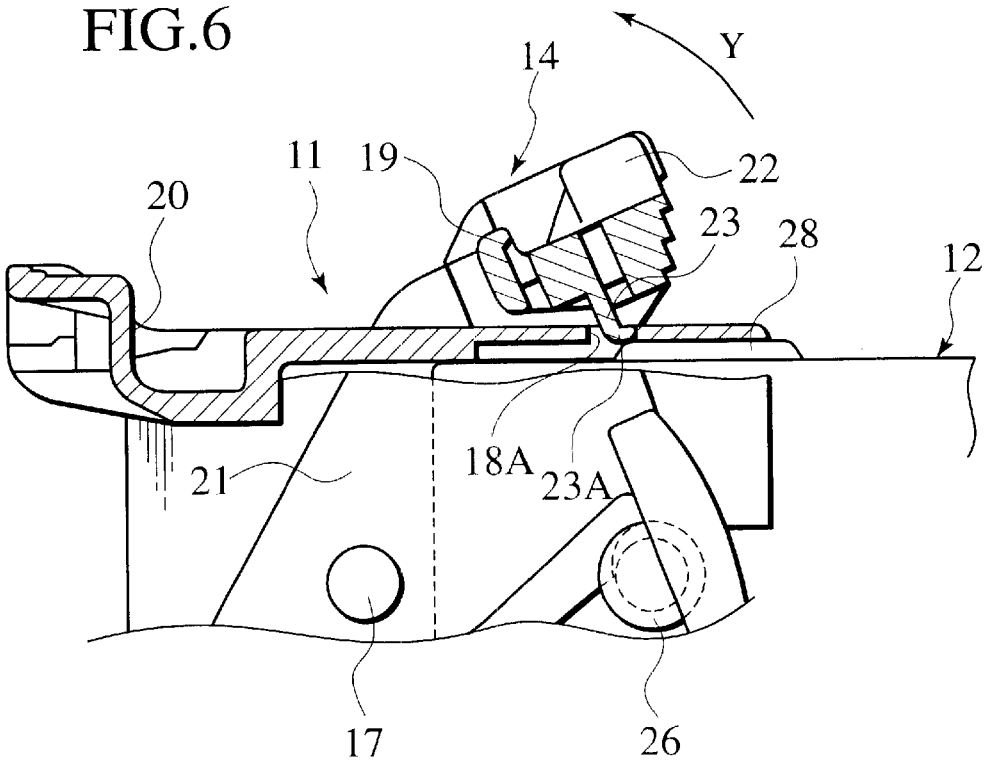
FIG. 6 is a sectional view showing an essential portion of a state in which a temporary locking state between a locking projection piece and a locking opening are unlocked in the embodiment.
Figure 7:
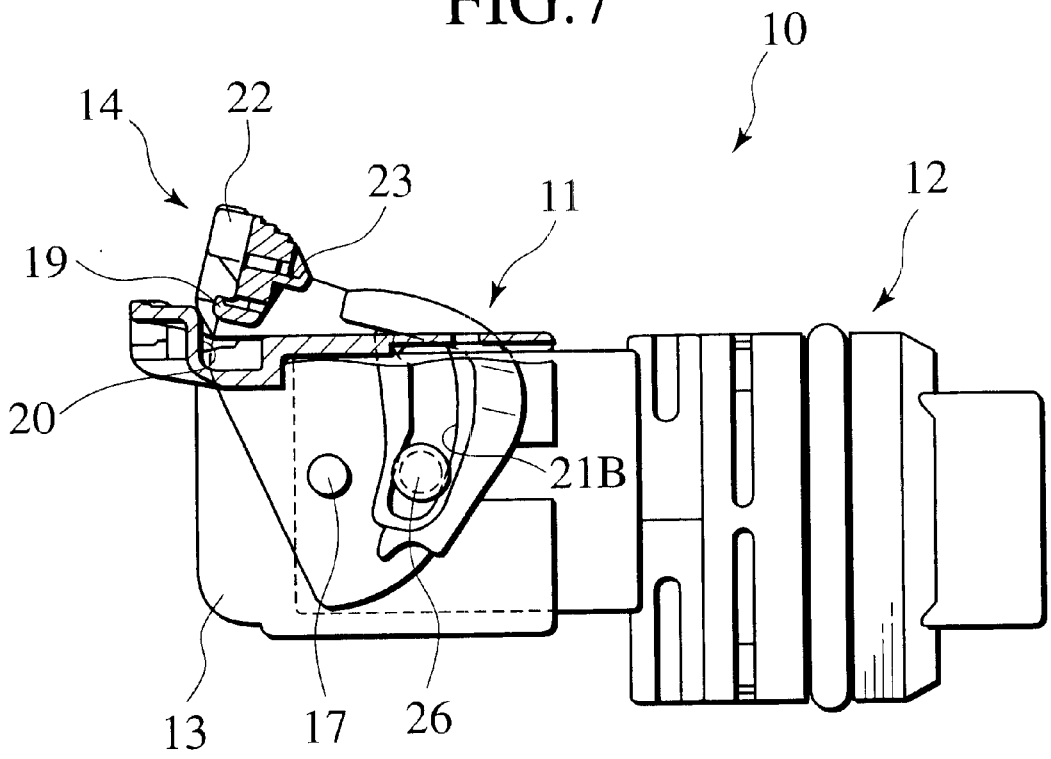
FIG. 7 is a side view showing a state in which the first connector and the second connector are completely connected to each other in the embodiment.

Then, if the second connector 12 is fitted into the connector housing 13 by a predetermined length, as shown in FIG. 5, the front end of the unlocking projection 28 formed on the upper wall 27 of the second connector 12 abuts against the tip end 23A of the locking projecting piece 23 which projects slightly into to the connector housing 13, and the tip end 23A pushes the locking projecting piece 23 rearward. At that time, as shown in FIG. 6, the tip end 23A is gradually pushed out from the housing through the locking opening 18A, and the locking state is eventually unlocked.

In a state in which the guide projections 26 enters the guide grooves 16A and the engaging guide grooves 21B, the lever 14 is turned in a direction Y shown in the drawing by turning the connecting plate 22 of the lever 14. With this operation, the guide projections 26 of the second connector 12 are guided by the guide grooves 16A and the engaging guide grooves 21B in a direction for deeply fitting the connectors by a low insertion force. With this operation, the first connector 11 and the second connector 12 are sufficiently fitted to each other and electrical connection therebetween is reliably established. The engaging portions 19 formed on the rear portion of the connector housing 13 engage the to-be engaged portions 20, thereby holding the fitting state between the first connector 11 and the second connector 12.

According to the connector-with-lever 10 of the present embodiment, it is unnecessary to provide a spring member between the lever 14 and the connector housing 13, and it is possible to easily assemble the lever 14 into the connector housing 13. Since no spring member is used, there is merit that the cost of the first connector 11 with lever can be reduced. Before the second connector 12 is fitted to the first connector 11, since the locking projecting piece 23 is temporality locked with the locking projecting piece 23, the lever 14 does not fall unintentionally.

The embodiment has been described above, but the present invention is not limited to the embodiment, and various changes associated with the subject matter of the invention can be made.

What is claimed is:

1. A connector comprising:

a first connector having a connector housing;

a second connector;

a lever turnably mounted to the connector housing of said first connector, in which said first connector and said second connector are connected to each other by operating the lever;

a lever locking means for temporarily locking said lever with said connector housing before said first connector and said second connector are connected to each other, said lever locking means comprising a locking projection piece integrally formed with the lever; and an unlocking means for unlocking the temporary locking state of said lever when said first connector and said second connector start being connected to each other, wherein the second connector comprises at least one guide projection formed for engagement with the first connector, the lever comprises at least one engaging guide groove formed for engagement with the second connector, the connector housing of the first connector comprises at least one guide groove formed for engagement with the at state, the at least one guide groove of the first connector and a tip end of the at least one engaging guide groove of the lever are in superposed positions for receiving the at least one guide projection of the second connector, allowing the lever to be engaged with the second connector.

2. The connector according to claim 1, wherein said lever locking means further comprises a locking opening formed in said connector housing and the locking projection piece projects from said lever, said locking projection piece is inserted into and engaged with said locking opening, and said lever holds the temporary locking state with respect to said connector housing.

3. The connector according to claim 1, wherein said unlocking means comprises a projection formed on a connector housing of said second connector, said projection abuts against said locking projection piece to push said locking projection piece from said locking opening out of the connector housing, thereby unlocking the temporary locking state of said lever.

* * * * *